US008837678B2

(12) United States Patent
Turqueti et al.

(10) Patent No.: US 8,837,678 B2
(45) Date of Patent: Sep. 16, 2014

(54) LONG-LASTING PULSEABLE COMPACT X-RAY TUBE WITH OPTICALLY ILLUMINATED PHOTOCATHODE

(75) Inventors: Marcos Turqueti, Vista, CA (US); Guilherme Cardoso, Carlsbad, CA (US); Jonathan Kidney, Alexandria, VA (US)

(73) Assignee: Creative Electron, Inc., San Marcos, CA (US)

( * ) Notice: Subject to any disclaimer, the term of this patent is extended or adjusted under 35 U.S.C. 154(b) by 398 days.

(21) Appl. No.: 13/209,203

(22) Filed: Aug. 12, 2011

(65) Prior Publication Data

US 2013/0039474 A1 Feb. 14, 2013

(51) Int. Cl.

| | |
|---|---|
| ***H01J 35/06*** | (2006.01) |
| ***H01J 9/12*** | (2006.01) |
| ***H01J 9/26*** | (2006.01) |
| ***H01J 35/08*** | (2006.01) |

(52) U.S. Cl.

CPC ..... *H01J 35/065* (2013.01)
USPC ..... 378/124; 378/136; 445/28

(58) Field of Classification Search

USPC ..... 378/121–142
See application file for complete search history.

(56) References Cited

U.S. PATENT DOCUMENTS

| | | | | |
|---|---|---|---|---|
| 4,821,305 | A * | 4/1989 | Anderson | 378/136 |
| 6,324,257 | B1 * | 11/2001 | Halavee | 378/121 |
| 6,728,335 | B1 * | 4/2004 | Thomson et al. | 378/65 |
| 6,816,573 | B2 * | 11/2004 | Hirano et al. | 378/114 |
| 2004/0218720 | A1 * | 11/2004 | Swanson et al. | 378/119 |
| 2006/0274889 | A1 * | 12/2006 | Lu et al. | 378/122 |

* cited by examiner

*Primary Examiner* — Hoon Song
*Assistant Examiner* — Danielle Fox
(74) *Attorney, Agent, or Firm* — Jonathan Kidney

(57) ABSTRACT

Systems and methods are described for a compact x-ray system that uses optical energy for triggering x-ray generation rather than a traditional filament. A photocathode is illuminated and the ensuing electrons are directed to an anode resulting in x-ray generation, resulting in increased x-ray source durability. Pulsing, beam forming, scanning, varying x-ray characteristics, longevity of source and other desirable attributes not currently available in the state of the art are achievable, through the use of shaped, multi-materialed photocathodes, shaped, multi-materialed anodes, arrays of optical lines, and so forth, as some examples. Inexpensive, highly controllable sources such as solid-state lasers can be used, permitting a wide variety of applications and power levels.

25 Claims, 9 Drawing Sheets

LONG-LASTING PULSEABLE COMPACT X-RAY TUBE WITH OPTICALLY ILLUMINATED PHOTOCATHODE

FIELD

The present disclosure is in the field of x-ray generation systems.

BACKGROUND

The basic components of a modern x-ray tube consist of a high vacuum tube containing the anode/target and the cathode/electron source. The operation of the tube also requires a high voltage power supply to create an electric field between the cathode and anode, and a low voltage power supply for exciting the electron source. The general idea behind the x-ray tube has not changed significantly in the last 100 years and is relatively simple: the electron source (heated tungsten filament) is placed in the electric field that accelerates electrons towards the target (anode) and if the electrons have enough energy, they will generate x-rays when they hit the target by one of two mechanisms. The first mechanism is the Bremsstrahlung effect, where the electrons suddenly decelerate when they interact with the atoms in the anode/target. This sudden braking of the electrons causes them to lose kinetic energy and emit the difference in the form of x-rays photons and heat. The other mechanism of x-ray emission happens again when an electron reaches the anode, but instead of only being decelerated, the electron knocks out an electron from the anode material. This causes an electron from a higher energy level in the affected atom to drop down to fill this vacancy. Because the electron that will fill the vacancy comes from a higher energy level, it must emit a photon with energy equal to the difference between the energy levels involved in the process. This is referred to as a characteristic x-ray because the energy emitted is specific to the anode material, with different materials having distinct x-ray characteristic peaks.

Currently, commercial x-ray tubes utilize a heated filament as the electron source/gun. The average lifespan of a medical x-ray tube is only a few hours at normal filament heating. Refurbishing the filament is an expensive process because the pressurized tube (glass) must be opened, the filament exchanged, and then the tube must be re-sealed and evacuated to a high vacuum. Further, the x-rays cannot be rapidly pulsed due to the nature of the filament's slow heat response. Moreover, switching of the "focusing" electric field is known to strain the filament.

Therefore, there has been a long-standing need in the x-ray generation community for new methods and systems that address these and other deficiencies in the art.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, an x-ray generating device is provided, comprising: a substantially sealed envelope having a portion that allows x-rays to pass; an anode having a portion interior to the envelope, the anode capable of generating x-rays in a predetermined direction when interacted upon by electrons; a cathode having a portion interior to the envelope and having a face containing a photocathodic material substantially opposite the anode; a voltage differential between the cathode and the anode; and a light-guiding transmission line directing light to the face of the cathode, wherein the light impinging on the photocathodic material generates electrons which are directed to the anode by the voltage differential, resulting in x-rays being generated by the anode and radiated out of the envelope.

In another aspect of the disclosed embodiments, a method for assembling a light-activated photocathodic/anode x-ray device is provided, comprising: forming a cathode with a photocathodic face by disposing a photocathodic material on a face of the cathode; positioning a face of an anode displaced from and substantially opposite from the photocathodic face, the anode capable of generating x-rays in a predetermined direction when interacted upon by electrons; enclosing the photocathodic face and the face of the anode in a sealable envelope; the envelope having a portion that allows x-rays to pass; directing an end of a light-guiding transmission line towards the photocathodic face in the envelope; sealing the envelope to provide an environment between the photocathodic face and the face of the anode that allows substantially unrestricted travel of electrons; and attaching a voltage or current carrying line to at least one of the cathode and anode, wherein light impinging on the photocathodic face generates electrons which are directed to the anode by an impressed voltage differential, resulting in x-rays being generated by the anode and radiated out of the envelope.

In yet another aspect of the disclosed embodiments, a method of generating x-rays is provided, comprising turning on a light source to an x-ray device comprised of: a substantially sealed envelope having a portion that allows x-rays to pass; an anode having a portion interior to the envelope, the anode capable of generating x-rays in a predetermined direction when interacted upon by electrons; a cathode having a portion interior to the envelope and having a face containing a photocathodic material substantially opposite the anode; a voltage differential between the cathode and the anode; and a light-guiding transmission line directing light from the light source to the face of the cathode, wherein the light impinging on the photocathodic material generates electrons which are directed to the anode by the voltage differential, resulting in x-rays being generated by the anode and radiated out of the envelope.

In various disclosed embodiments, variations of the aspects comprise one or more of the following: at least the light-guiding transmission line is at least one or more fiber optic lines; non-visible light is transmitted; at least one of the fiber optic lines is directed from at least one of an anode side and a cathode side; a laser feeds light into the light-guiding transmission line, the laser having at least one of a continuous mode of operation and a pulseable mode of operation; the sealed envelope is either vacuumed or contains a gas; the cathode is entirely formed of the photocathodic material; the photocathodic material is at least one of shaped, multi-materialed, and multi-layered; the photocathodic material is comprised of at least one of ytterbium (Yb), gallane-arsine (Ga—As), and cesium-antimony (Cs—Sb); the anode is comprised of a material that provides a specific x-ray characteristic; tungsten is used; tungsten; and the anode contains a face that is multi-faced, wherein at least one of the anode's multi-face is pointed in a different direction than an other one of the anode's multi-face.

In various other disclosed embodiments, variations of the aspects comprise one or more of the following: the face of the anode is comprised of a plurality of different materials that provide different x-ray characteristics; the portion of the sealed envelope is comprised of a material that is at least one of substantially transparent to x-rays and possesses an x-ray altering attribute; the anode is comprised of a plurality of anodes and the cathode is comprised of a plurality of cathodes; a plurality of fiber optic lines are arranged to form a geometric array, directing light in a geometric pattern upon the face of the cathode; at least one of a charged fielding arm, affecting a position of electrons generated from the photocathodic material, is disposed on the face of the cathode and an electron amplification grid positioned between the cathode and the anode; and an electron amplifier is positioned on the face of the cathode, proximal to the photocathodic material.

In various other disclosed embodiments, variations of the aspects comprise one or more of the following: attaching a light-generating source to an other end of the light-guiding transmission line; x-ray beam forming by at least one of adjusting the voltage differential, controlling a sequence of light transmissions within one or more of a plurality of light-guiding transmission lines, and moving either the anode or cathode; directing electrons from the photocathodic material to an electron amplification grid positioned between the cathode and the anode; and directing electrons from the photocathodic material to an electron amplification positioned on the face of the cathode.

DETAILED DESCRIPTION

Figure 1:
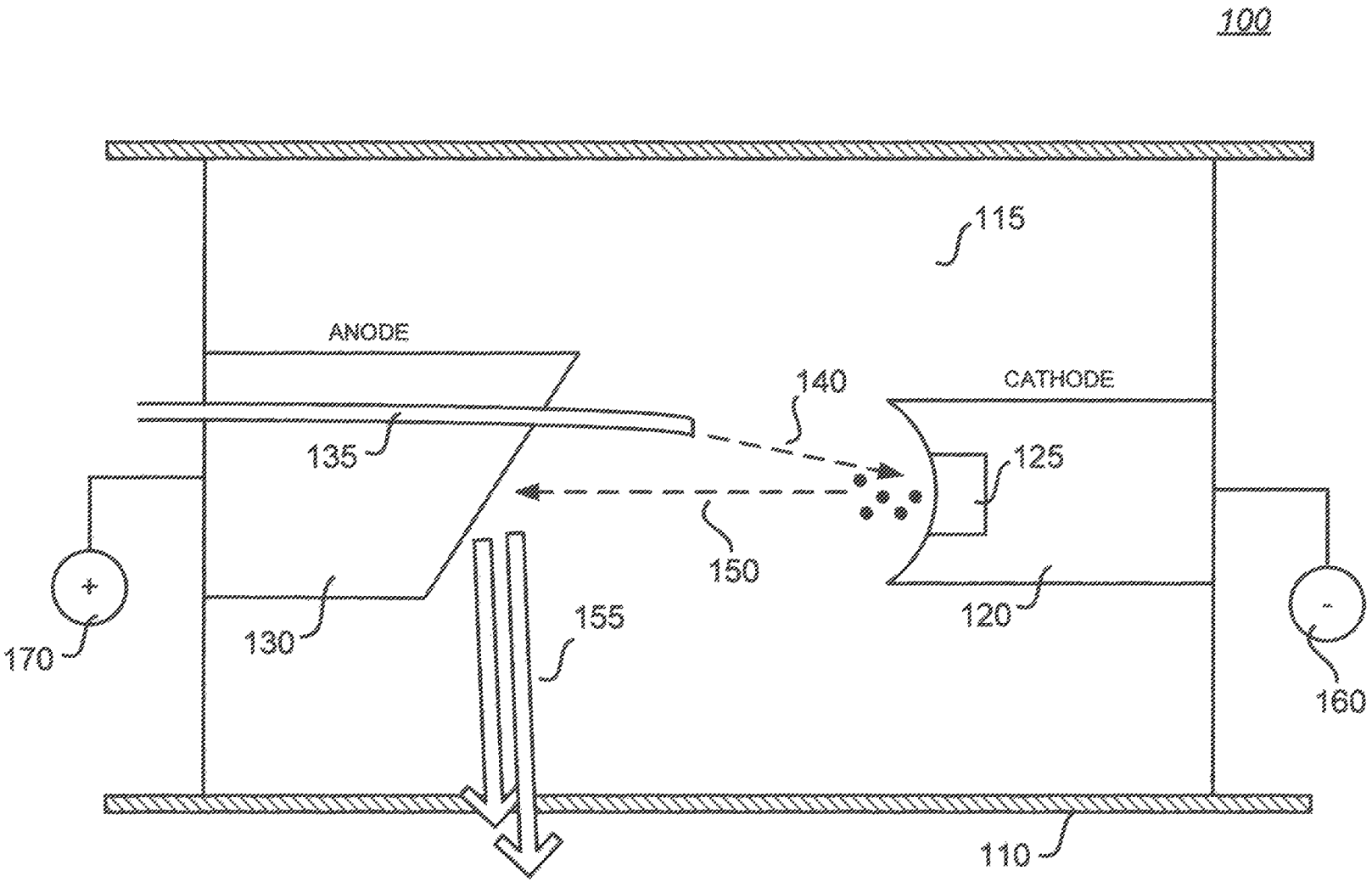
FIG. 1 is a cross-sectional illustration of an exemplary x-ray generating device utilizing a cathode/photocathode illuminated with a light conveying transmission line.

In various exemplary embodiments, a compact x-ray generating device is described that utilizes a photocathode as the electron source, whereas the photocathode releases electrons from photons directed to its surface guided by a "light" guiding transmission line or waveguide. The use of a photocathode eliminates the need for the traditional tungsten electron source element and the use of the transmission line/guide allows for precise targeting of the photocathode. In some embodiments, the photocathode is manufactured with ytterbium or another material(s) that possesses a suitable work function. The benefits of "targeting" the photocathode, particularly in the context of a multi-materialed photocathode and/or shaped photocathode, with a "light" guiding mechanism will be evident below.

Using, for example, an optical fiber line as a suitable transmission line/guide, the light source can be exterior to the tube, allowing easy maintenance of the light generating system, as well as easily protecting/guiding the light to the appropriate target. If the light generating system is a lasering system, then very fast light pulses can be produced, and ensuing fast pulsed x-rays can be generated. In some embodiments, a single transmission line (e.g., fiber optic line) may be utilized while in some other embodiments multiple fiber optic lines (e.g., bundles) may be used either with a single light source (e.g., laser) or multiple lasers, as according to design preference. A consequence of the use of multiple guiding mechanisms and different strike angles is the ability to achieve controllable x-ray beam forming, broader beams, and x-ray beam scanning, as several possible examples.

In some embodiments, the photocathode may be completely comprised of a photocathodic material or partially comprised of it. Therefore, the photocathode (or features of it) may be shaped with different materials, and the anode (or features of it) may also be shaped and/or comprised of different materials—enabling the generation of x-rays having different characteristics (for example, direction, energy, frequency, profile, etc.). Shaping of the photocathode can provide an electrostatic "lensing" effect that can operate to focus the electrons onto the anode, thus increasing efficiency by reducing halo effects. Also, shaping can be designed to accommodate possible electrical conductivity variations when submitted to temperature variations. The photocathode arrangement described in various exemplary embodiments below demonstrate itself as being highly suitable for generating a microfocus X-ray, since the photocathode can also operate as the electrostatic lens.

It is noted that the use of a photocathode for x-ray generation is described in Rentzepis's U.S. Pat. No. 6,042,058, patent titled "Ultrashort Time-Resolved X-ray Source," however, there is no description of a "physical" light guiding mechanism nor the use of a specifically shaped photocathode, anode surfaces/materials, nor the combination of the light guiding mechanisms in conjunction with shaped-nodes or materials as described in the instant application. Additionally, Rentzepis requires field focusing plates to assist in shaping the electron beam towards the anode and the resulting x-ray beam, which need occasional calibration and adjustment, which are obviated by the arrangement presented by the inventors of the instant application.

It is also known that light guiding mechanisms, such as fiber optic lines, when exposed to high levels of x-ray radiation will "cloud" up, rendering them inoperable as an excitation signal carrier. Therefore, the prior art considers the use of guiding light via fiber optic lines in this field as a failure point. However, in the exemplary embodiments described below, this difficulty is overcome by judicious placement of the guiding mechanisms (e.g., fiber optic lines), which can minimize exposure to x-rays. Further, low power x-rays (or controlling the amount and/or direction of the x-rays to avoid exposure) can avoid the issues of the prior art and therefore facilitate the use of guiding mechanisms such as, for example, fiber optic lines as an excitation signal carrier. To date, the inventors are not aware of any such system for x-ray generation as described herein.

Returning now to photocathodes as an electron excitation medium, several examples of materials that may be suitable for use in a photocathode have been examined. A non-limiting short list of some of these materials is presented in Table 1 below, listing their relative work function value.

TABLE 1

| Material | ϕ (eV) |
|---|---|
| Sb—Cs | 3.3 |
| Ga—As | 5.3 |
| Ag—O—Cs | 0.7 |
| $K_2CsSb$ | 2.1 |
| $Cs_2Te$ | 3.5 |
| $Cs_3Sb$ | 2.05 |

Many parameters relevant for the performance evaluation of a photocathode depend on the application that it is going to be used for, but in most cases the work function (ϕ) and the quantum efficiency (QE) are of fundamental importance. The work function is defined as the minimum energy needed to remove an electron from a material. In the case of the photoelectric effect, this energy level will be given by the energy of the photon that is interacting with the atom by $\phi=hf_o$, where ϕ is the work function, h is the Planck's constant and $f_o$ the minimal frequency necessary for a photon to remove an electron from the material. The other important parameter is the anode quantum efficiency, and it is defined as the number of photo-emitted electrons per photon impacting the material.

As described above, the exemplary embodiments utilize a photocathode (or any similarly behaving assembly) that does not use any filament, meaning that no extra power lines are needed for the cathode assembly. The photon source can be easily obtained via a high power light-emitting source (for example, a laser diode or a high-powered LED, etc.). Since it is possible for the light-emitting source to be damaged from exposure to x-rays it can be externally situated and coupled via a guiding mechanism, such as an optical fiber to direct the photons towards the photocathode.

It is noted that while the light-emitting source (aka light generator) may be a laser, or LED or other light generating source, other forms of light generation may be used without departing from the spirit and scope of this disclosure. Therefore, while the term "laser" may be used as describing the light generating source, other now known or future devised light generating sources may be utilized. Further, it is expressly understood that the term "light" as used herein is a generic term describing electromagnetic radiation that can be within the visible spectrum and/or non-visible spectrum. Thus, ultra-violent (UV) light or infrared light may, as non-limiting examples may fall within the purview of the term "light."

The use of metallic photocathodes offers some advantages over semiconductor or other types of photocathodes. First, they are easier to fabricate and do not require stringent vacuum conditions as more complex materials do. Furthermore, Yb has a work function of only 2.6 electron volts (eV), which easily falls within the range of widely available commercially laser semiconductors which can operate up to 3.2 eV (~405 nm). Though photocathodes based on materials such as gallane-arsine (Ga—As) have a high quantum efficiency (which is very desirable), its work function is in the UV, of which lasers operating in that range are not yet commercially available. However, upon the commercial availability of UV lasers/emitters, the exemplary embodiments may be so configured for use with a Ga—As photoelectrode.

In experiments conducted by the inventors, a semiconductor laser with a wavelength of 405 nm was used with satisfactory results. Of course, the laser can be of any desirable wavelength, according to design and performance requirements. The choice of wavelength will most likely depend on the response characteristics of the photomaterial on the cathode as well as on the available laser technology. In the experimental model, a photocathode was fabricated with a metal-based ytterbium (Yb) surface on an underlying copper substrate. The photocathode was immersed in a high vacuum chamber at approximately $10^{-7}$ Pa. This photocathode was coupled with a multimode optical fiber to a laser diode operating at approximately 405 nm. The beam spot on the photocathode was circular with an area of approximately 0.5 $cm^2$, and the laser power was set to approximately 250 mW. Cathode-to-anode voltage was set at approximately 80 kV, with a sustained beam current performance demonstrated of approximately 120 μA. The anode used in the experiments was a solid tungsten disc with a diameter of approximately 0.5 cm supported by a solid copper substrate. The angle of the anode with the incoming electron beam was set at approximately 20 degrees, with a focal spot on the anode of approximately 6 μm in diameter.

While the above parameters were utilized for the experimental model, it is understood that one of ordinary skill in the art may alter the configuration and performance characteristics, according to design preference. For example, depending on the choice of materials, lasering power, etc., the exemplary embodiments are believed to be able to achieve higher levels of beam current, for example, beyond 600 μA. As non-limiting examples, the area of the photocathode exposed to the light can be increased, and/or the laser power will be optimized so as to maximize the cathode current with this new increased active area, and/or different types of photocathode materials can be used. In some experiments by the inventors, it was discovered that utilizing thin film instead of bulk materials increases the quantum efficiency of photocathode materials. The higher beam current capability allows the exemplary x-ray system to be well suited for medical or other high power applications.

The experimental Yb based photocathode was shown to have a quantum efficiency on the order of 0.2%. Although other materials that have higher quantum efficiency and work function compatible with current solid-state laser diodes exist, such materials usually have certain setbacks, for example, requiring higher vacuum levels, having shorter operational lifetimes, and in some cases, higher manufacturing costs.

For example, in addition to testing a Yb-based electrode, a cesium-antimony (Cs—Sb or Sb—Cs) based photocathode was tested that demonstrated a higher quantum efficiency, on the order of 10%. Because of the higher quantum efficiency, this kind of photocathode does not require as high a powered light/lasering source. Although the Cs—Sb photocathode can be utilized, the cost of the enveloping tube is believed to be higher, and it is understood that the life of the Cs—Sb photocathode is less than other photoelectrode materials. These suspicions were confirmed during experimentation, with the Cs—Sb photocathode demonstrating a high susceptible to surface contamination, which degraded its performance. Another observed difficulty was its degradation of performance over time. The mechanism causing the degradation was not fully understood, but the inventors suspect that it was caused by evaporation and dissociation. In contrast, there was no evidence of this kind of degradation with the Yb photocathode. Nonetheless, even with its current difficulties, Cs—Sb can be a viable alternative for the Yb photocathode and, due to its much higher quantum efficiency, has the potential to deliver higher levels of current. So, with or without the above-mentioned complications with Cs—Sb, the inventors believe that it can be a suitable photoelectrode material, if properly approached.

As an example of one possible approach to mitigating or addressing some of the problems associated with the Cs—Sb photoelectrode, it is proposed that the photocathode can be covered with a protective layer. While this extra "manufacturing" step would further complicate the fabrication process it is understood that, depending on the performance benefits, it may present itself as a reasonable extra step for the added performance.

In view of the above introduction, several exemplary embodiments of the exemplary x-ray system and method(s), and variations thereof, are detailed in the following description.

FIG. 1 is an cross-sectional illustration of an exemplary x-ray generating device 100, with an envelope 110 containing cathode 120 and anode 130, the former being illuminated by light 140 emanating from a photon guiding transmission line, shown here as optical fiber 135, to impinge on photosensitive material 125 disposed on the conformed surface 128 of cathode 120. While optical fiber 135 is shown as being "fed" through a channel formed in anode 130, the optical fiber 135 may be situated at other places, as according to design preference. It should be noted that while the exemplary embodiments shown herein illustrate the photon guiding mechanism as a fiber optic line, it is expressly understood that other mechanisms for light guidance/transmission may be utilized. For example, waveguides, optical transmission lines, etc. may be used, as according to design preference.

As described above, light 140 impinging on photosensitive material 125 results in electrons being generated and, according to the potential between cathode 120 and anode 130 from potentials 160 and 170, respectively, the electrons are directed 150 to anode's 130 surface. The resulting generated x-rays 155 are directed via a predetermined surface angle of anode 130 to propagate out of envelope 110 to a target (not shown).

Potentials 160 and 170 may have a fixed voltage differential or a variable voltage differential and are shown as being negative and positive, respectively, to conform to standard polarity conventions. The voltage differential between potentials 160 and 170 signify the difference in potential and can, in some embodiments, be achieved by simply grounding potential 160 with potential 170 set at a higher potential. The magnitude of the potential difference is known to assist in "driving" the electrons released from the photosensitive material 125 to the anode 130.

It should be noted that chamber 115 is enclosed by envelope 110 and may comprise a vacuum to avoid the presence of any particles or "gases" that may interfere with or adsorb the generation/transmission of x-rays. In some embodiments, chamber 115 may contain a sealing gas or material that is transparent to x-rays or has some altering effect on the x-rays. For example, portions of chamber 115 that are subject to x-rays may be filled with a material that is x-ray transparent/altering, while portions of chamber 115 that are subject to the free-space propagation of light from fiber optic line 135 may be filled with a light-transparent material. Therefore, while FIG. 1 and the ensuing FIGS. show a single chamber 115 that is presumably vacuum-filled, it is expressly contemplated that chamber 115 may be multi-chambered (either vertically, horizontally, annularly, and/or at an angle) and it may be appropriately non-vacuumed, as according to design preference.

Additionally, while conventional practice is to have envelopes 110 or tubes typically formed from glass or equivalent, the exemplary embodiments may use a non-glass material without departing from the spirit and scope of this disclosure. For example, the envelope 110 may be formed of a material that is not glass, or formed of glass but have a carbon based window (for example, a carbon fiber insert) that is more transparent to x-rays than glass.

Depending on the length and rigidity of the photon guiding transmission line (e.g., fiber optic line 135), it may be necessary to secure the fiber optic line 135 from movement. In some embodiments, a mechanical securing system (e.g., friction) can be used or a chemical-based system (e.g., adhesive), or any other suitable system/approach. In other embodiments, it may possible to allow the fiber optic line 135 to be controllably moved, depending on design objectives. For example, it is contemplated that in one implementation, upon "expiration" of a particular portion of photosensitive material 125, the fiber optic line 135 may be controllably adjusted/directed to a portion of the photosensitive material 125 that has not "expired," if so designed. Accordingly, based on the particular configuration contemplated, the fiber optic line 135 may or may not be secured from movement. Such considerations are understood to be applicable to the embodiment shown above and also, as appropriate, to the embodiments described below.

Figure 2:
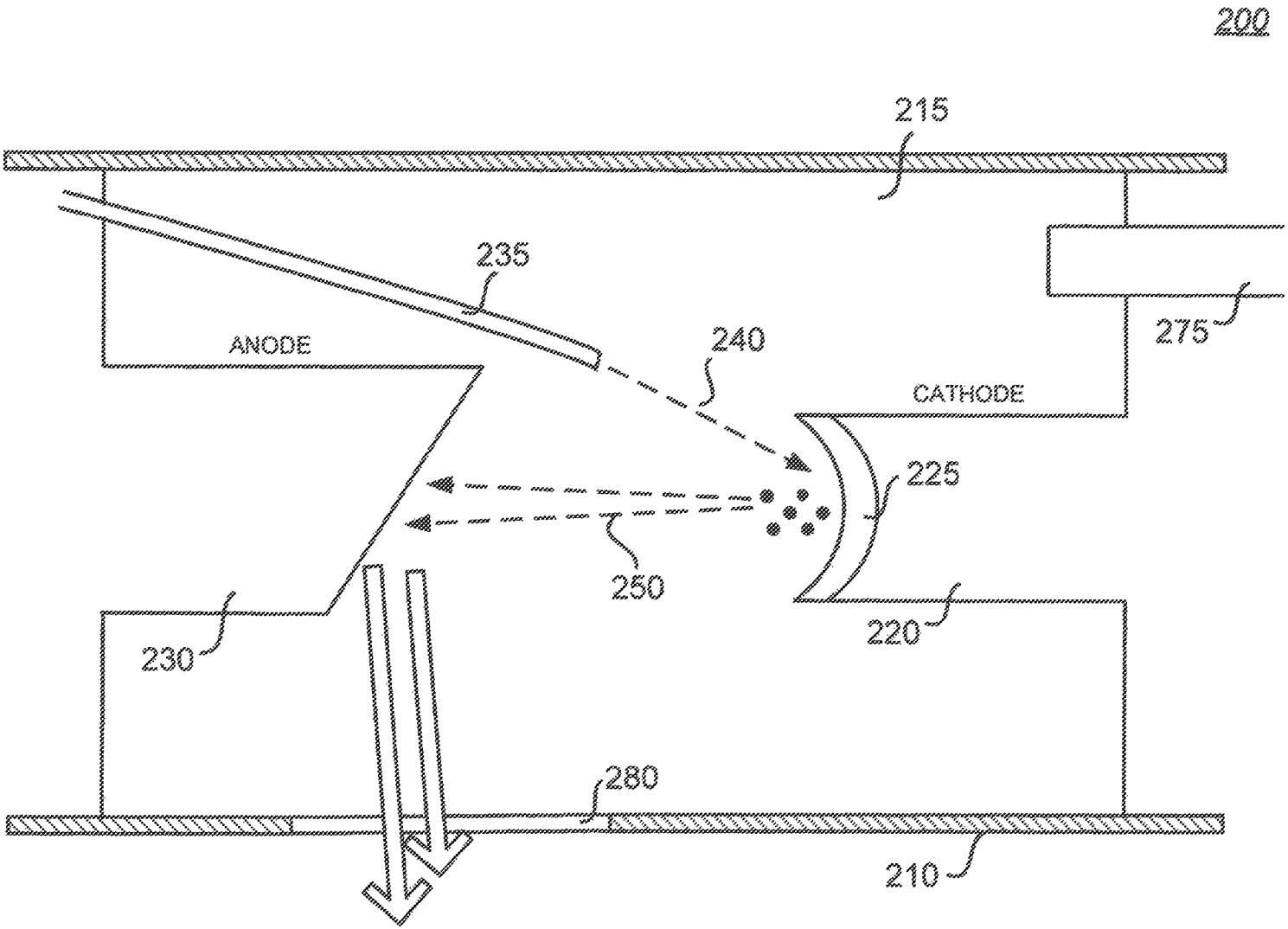
FIG. 2 is a cross-sectional illustration of another exemplary embodiment utilizing a completely photomaterial-covered cathode and a vacuum port.

FIG. 2 is an cross-sectional illustration of another exemplary x-ray generating device 200, with an envelope 210 containing cathode 220 and anode 230, the former being illuminated by light 240 emanating from light guiding mechanism, shown here as an optical fiber 235 situated exterior to the anode 230, to impinge on photosensitive material 225 disposed on the conformed surface of cathode 220. Chamber 215 is shown with vacuum port 275, which facilitates the creation of a vacuum within chamber 215. Other possible methods for creating a vacuum maybe used as according to design preference. It is noted that in this embodiment, the photosensitive material 225 is shown as being completely disposed on the surface of cathode 220 to demonstrate the fact that some "easier" methods for coating cathode 220 may not allow for selectively covering the surface of cathode 220, as shown in FIG. 1.

In operation, released electrons from the photosensitive material 225 are directed 250 to anode 230, resulting in x-rays 280 being generated. The strike angle and/or surface angle of anode 230 is predetermined to direct the ensuing x-rays 280 through window 280, which may be especially transparent to x-rays, or in an alternative provide an alteration of the x-ray characteristic(s) emanating from anode 230. For example, window 280 may be a carbon window (minimal adsorption to the x-rays) or facilitate some adjustment of the exiting x-rays. In one embodiment, window 280 may act as a filter to selectively reduce certain x-ray frequencies; in another embodiment, window 280 may act as a focusing or beam narrowing/directing feature, to narrow or direct the exiting x-rays, according to the characteristics of window 280. In another embodiment, widow 280 may provide a combination of features listed above, as well as some mechanism for focusing, if so desired.

It is noted that the surface of cathode 220 is shown in this embodiment with a parabolic shape to assist in generating a somewhat homogeneous electron microfocus on anode 230. Based on the focal point and contour of cathode's 220 surface, the target size on anode 230 can be tailored, as well as its shape and/or location on anode 230. It is also noted that in various modes of operation, it is contemplated that cathode 220 is allowed to rotate to cause different portions of the photosensitive material 225 to be illuminated, thus dissipating any heat buildup on any particular portion of the photosensitive material 225. This may be accomplished by physically rotating the cathode 220 (for example, automatically) or via a directing of the light energy to different portions of the photosensitive material 225, as further demonstrated in various embodiments described below.

Figure 3:
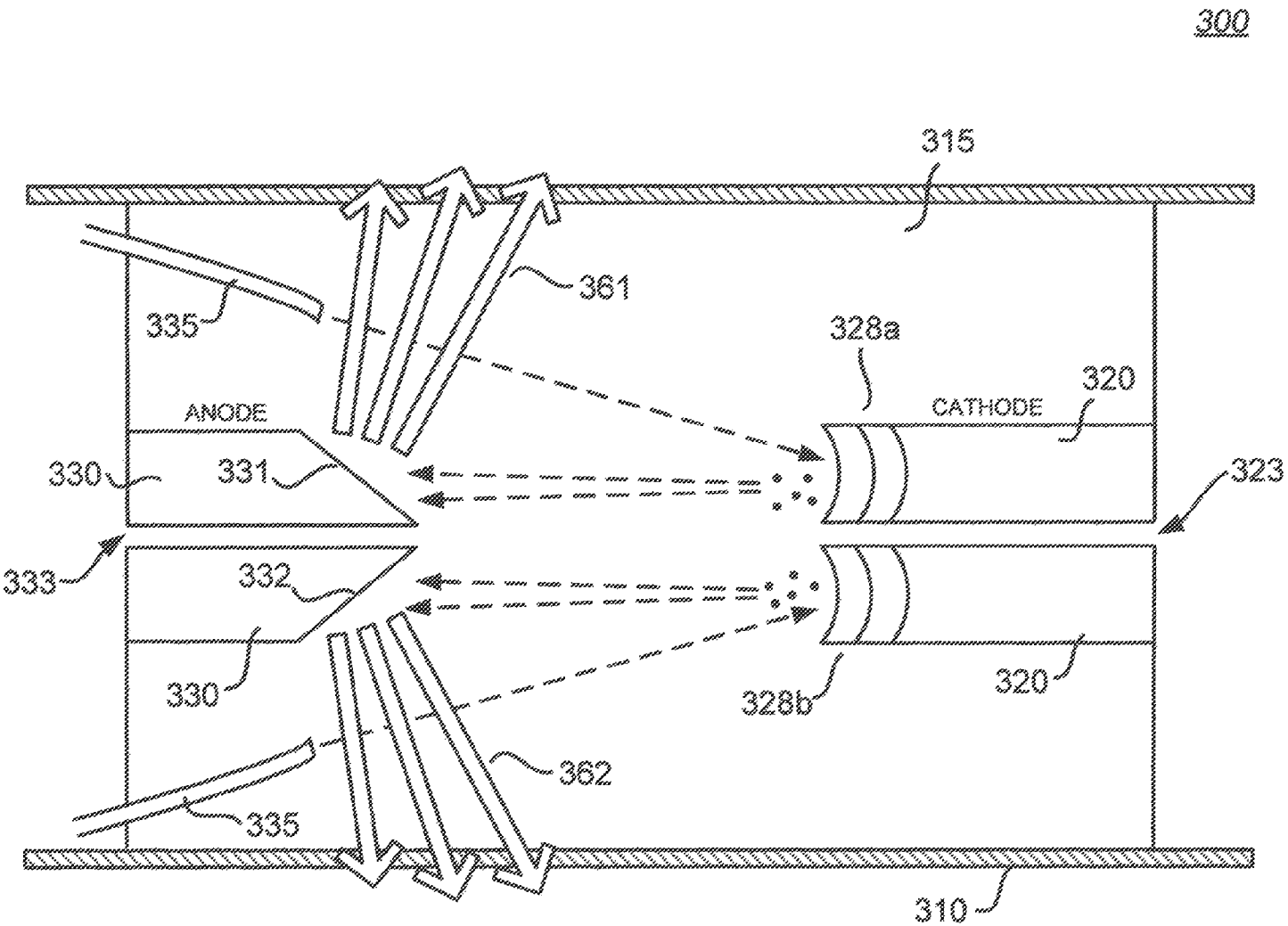
FIG. 3 is a cross-sectional illustration of another exemplary embodiment using a multi-fibered, "layered" multi-photocathode and multi-anode.

FIG. 3 is a cross-sectional illustration of an exemplary x-ray generating device 300, with an envelope 310 and chamber 315 containing multi-cathode 320 separated by optional gap 323, and multi-anode 330 separated by optional gap 333. Photocathodic materials 328*a*, 328*b* are disposed on surfaces of multi-cathode 320, shown here as being layered, which are illuminated with light emanating from any one or more of fibers 335, 337. Electrons released from photocathodic materials 328*a*, 328*b* are directed to surfaces 331, 332 of multi-anode 330 having strike angles tailored to direct the resulting x-rays to different directions 361, 362.

In one possible embodiment, the shape of multi-anode 330 may be devised to allow a radial pattern of x-rays, or a partially radial pattern. Optional gaps 323 and 333 may operate as a channel for vacuuming, if so desired. Further, with respect to optional gap 333 at the multi-anode 330, it may be utilized as an entrance point for fibers 335, 337. That is, rather than having the fibers 335, 337 disposed exterior to the multi-anode 330, they may be placed within the gap 333.

For generalness of construction, the photocathode comprising photocathodic materials 328*a*, 328*b* and "separate" multi-cathode 320, as according to design preference, may be entirely composed of the photocathodic materials 328*a*, 328*b*.

It is understood that photocathodic materials 328*a*, 328*b*, while shown as layered, can be deposited or formed on multi-cathode 320 in a single step or a single layer. It is also understood that photocathodic materials 328*a*, 328*b*, if being layered, may comprise different materials of themselves, that is, photocathodic material (328*a*, as one example) may be layered with different materials or even with a different layering mechanism, providing some property that is beneficial to the exemplary x-ray generating device 300.

As one of several possible non-limiting examples, an epitaxial layering method for a first layer may provide superior adhesion properties while a sputtering second layer may provide efficiency of application. As another non-limiting example, layering different materials may enable better thermal matching properties. As another non-limiting example, one layering method may provide a different surface texture or surface characteristic (e.g., rougher surface, orientation of molecules, etc.) that is beneficial.

As described in FIG. 2, the envelope 310 may be comprised of glass or a combination of materials, as according to design preference. It is noted that the strike angles or surface angle on the surfaces 331, 332 of multi-anode 330 may be varied, allowing the x-rays to be "directed" to a pre-determined direction.

While not explicitly shown, it is implicit in this and the following FIGS. that a potential is provided between (multi-) cathode 320 and (multi-) anode 330 to assist in "driving" the released electrons to the (multi-) anode 330. Photocathodic materials 328*a*, 328*b* can be comprised of different materials, thus allowing for different levels/amounts of electrons to be released.

In one mode of operation, photocathodic materials 328*a*, 328*b* may be of the same material, wherein upon a first photocathodic material 328*a* expiring, the second photocathodic material 328*b* can be utilized, for example as a backup. In this scenario, the exemplary x-ray system 300 would be "rotated" and the unused (second) photocathodic material 328*b* illuminated, to result in the same "upward" x-ray direction.

Figure 4:
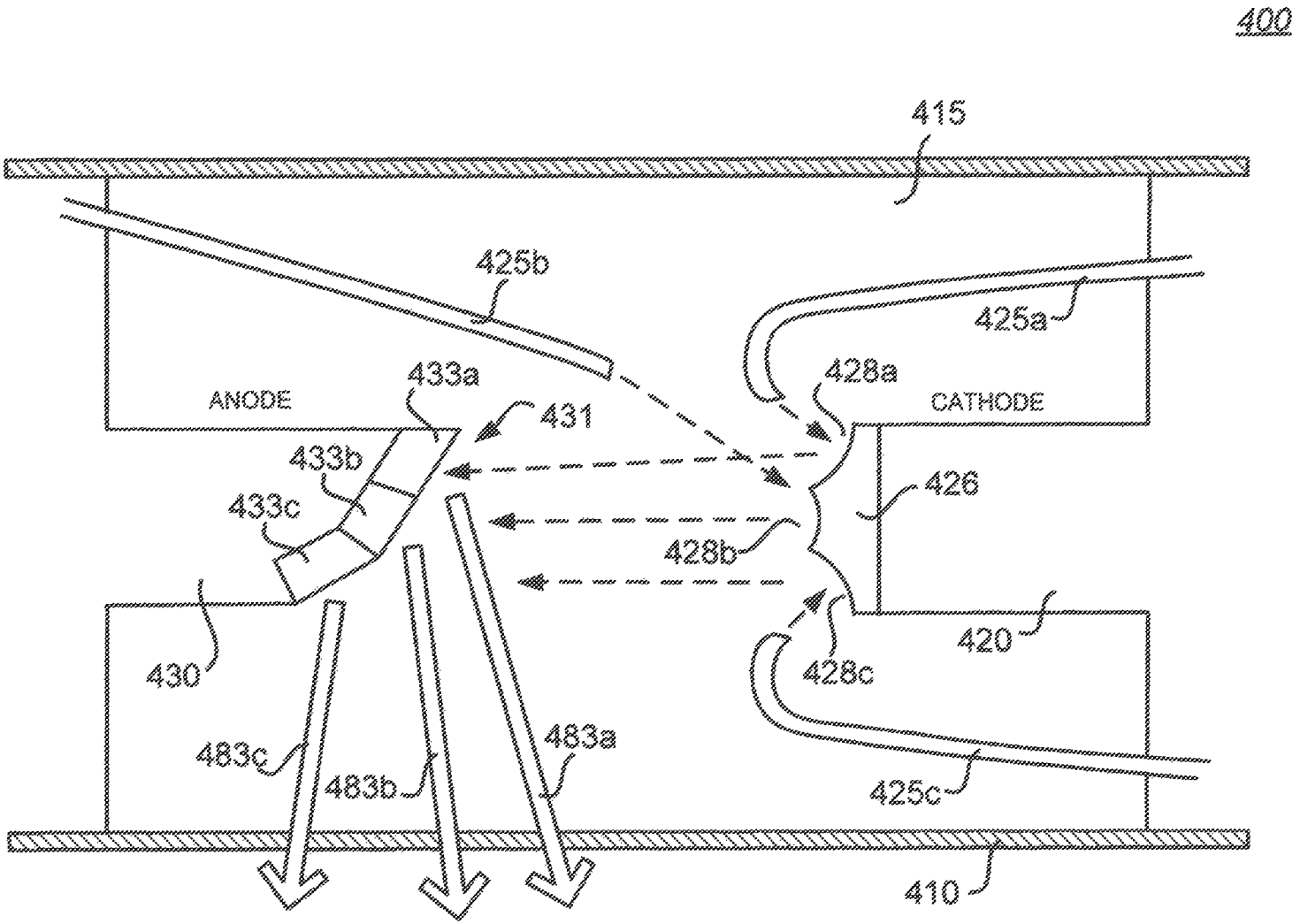
FIG. 4 is a cross-sectional illustration of another exemplary embodiment with a multi-shaped photocathode and multi-shaped anode.

FIG. 4 is a cross-sectional illustration of an exemplary beam forming x-ray generating device 400, with an envelope 410 and chamber 415 containing a cathode 420 with a shaped face 426 and an anode 430 with a multi-shaped face 431, and directing fiber optic lines 425*a*, 425*b*, 425*c*. It is noted in this embodiment the directing fiber optic lines can come from opposite directions (or any possible position) in the exemplary x-ray generating device 400, as illustrated by the locations of fiber optics lines 425*a*, 425*c* as compared to the location of fiber optic line 425*b*. Shaped face 426 of cathode 420 is shown as being comprised of a homogeneous material, but it is understood that it may be comprised of different photocathodic materials, according to design preference. The different types of shaping on the shaped face 426 allows for different types of "targeting" on the respective anode 430. While FIG. 4 shows a combination of a parabolic and tapered side faces, it is expressly understood that other shapes and contours may be utilized without departing from the spirit and scope of this disclosure.

The multi-shaped face 431 of anode 430 illustrates different target materials 433*a*, 433*b*, 433*c* that can be disposed on the surface of the anode 430. Depending on design requirements, a gap (not shown) may be necessary between the different target materials. The multi-shaped face 431 can be configured so that any one or more of the different target materials can be shaped and/or angled in a manner to allow a different exit angle for x-rays emanating from that material as compared to other materials on the anode 430. In this manner, not only can different x-ray characteristics be generated, depending on the target material struck, but also different angles of x-ray radiation can be achieved. For example, in FIG. 4 x-rays 483*a*, 483*b* from target materials 433*a*, 433*b* (having the "same" strike angle) are shown as emanating from their respective surfaces parallel to each other, while x-rays 483*c* from target material 433*c* (having a "different" strike angle) are shown as emanating from its respective surface in an angle that is different than of x-rays 483*a*, 483*c*.

Accordingly, a scanning x-ray device and method can be formulated by triggering in a predetermined order a sequence of the different fiber optic lines 425*a* or 425*b* and 425*c*. In an exemplary embodiment generating homogenous x-rays, the target materials 433*a*, 433*b*, 433*c* can be of the same material. In an exemplary embodiment generating non-homogeneous x-rays, the target materials 433*a*, 433*b*, 433*c* can be of different materials. It is expressly noted, that based on the described ability to perform x-ray scanning in a given plane, the exemplary embodiment of FIG. 4 can be modified to perform scanning in multiple planes, depending principally on configuring the orientation and strike angles of the multi-face shape 431 of the anode 430. For example, a particular face of the anode 430 may be oriented at an angle that is off-axis from the plane of the diagram—that is, oriented "sideways." Thus, utilizing the precepts described herein, 2-dimensional x-ray scanning can be achieved.

Granularity of the beams can be controlled by increasing or decreasing the number of available fiber optic lines, intensity of light, rate of pulsing, strike angles, etc. for multiply-directing (fine scanning) the x-ray beams. Also it will become apparent that a broad beam x-ray can be devised by turning on all the fiber optic lines at the same time, or a narrow beam can be devised by turning on only one or a subset of fiber optic lines at any single time.

Figure 5:
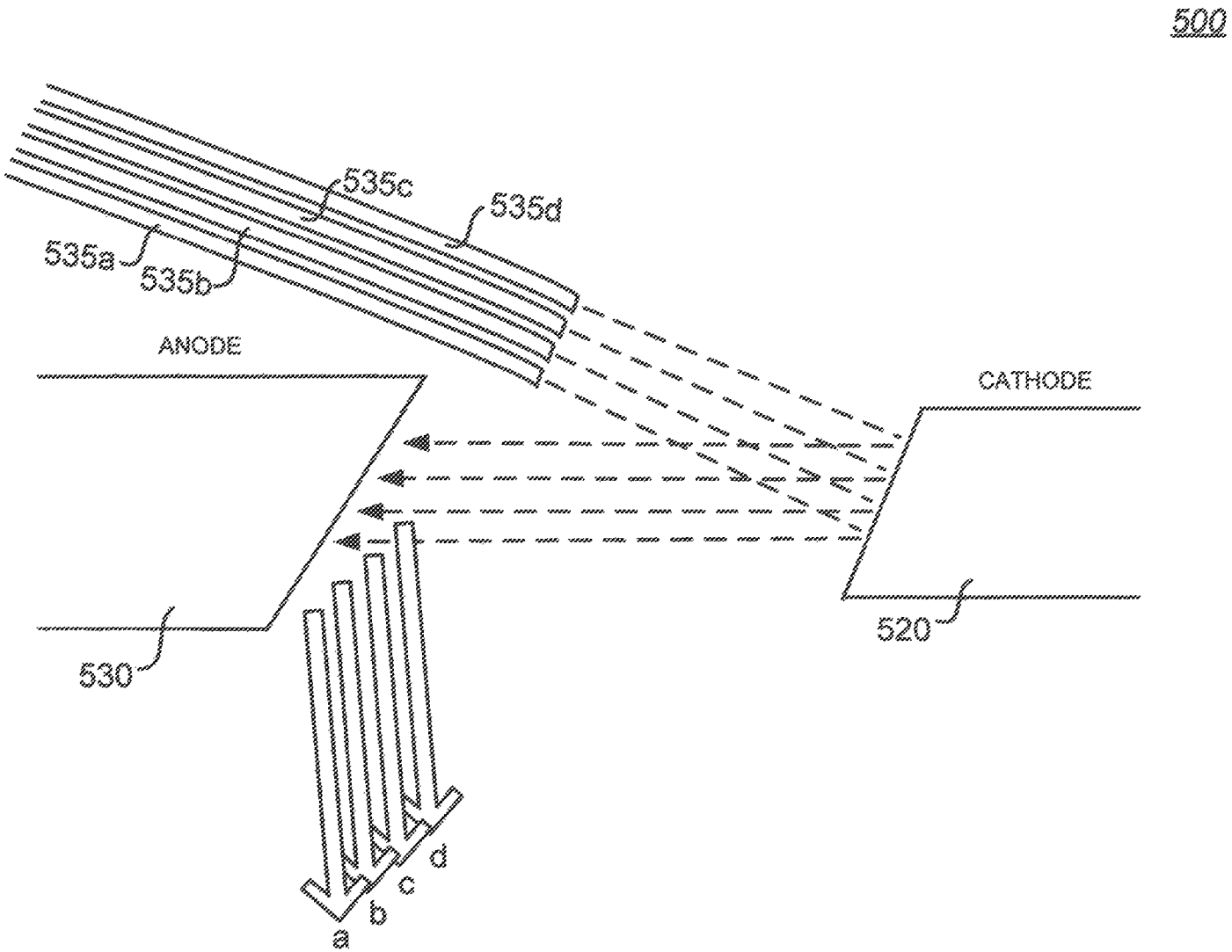
FIG. 5 is a cross-sectional illustration of another exemplary embodiment with an array of fiber optic lines generating beam-formed x-rays.

FIG. 5 is a cross-sectional illustration of an exemplary beam forming x-ray generating device 500 illustrating some of the "beam" aspects described above. FIG. 5 shows photocathode 520 opposite anode 530 with an array of directed fiber optic lines 535*a*, 535*b*, 535*c*, 535*d*, 535*d*. By triggering each fiber optic line in sequence (for example, the sequence "a" to "d"), a "forward" scanning x-ray system can be devised. Further, by simultaneously turning on sets of fiber optic lines, a "tight" beam or "broad" beam can be formed from the respective combinations. It is noted that while FIG. 5 illustrates each of the fiber optic lines giving rise to a specific x-ray beam, it is possible to arrange the fiber optic lines to overlap their photonic signatures to provide, for example, two fiber optic lines per photocathode area. That is, an increase of light energy can be obtained by superpositioning the fiber optic lines to target the same area on the photocathode. Therefore, by triggering specifically targeted "sets" of fiber optic lines, geometric patterns, multiple energies, beam forming, scanning, "reduced" heating by exposing different sections of the photocathode 520, and so forth are achievable.

Figure 6:
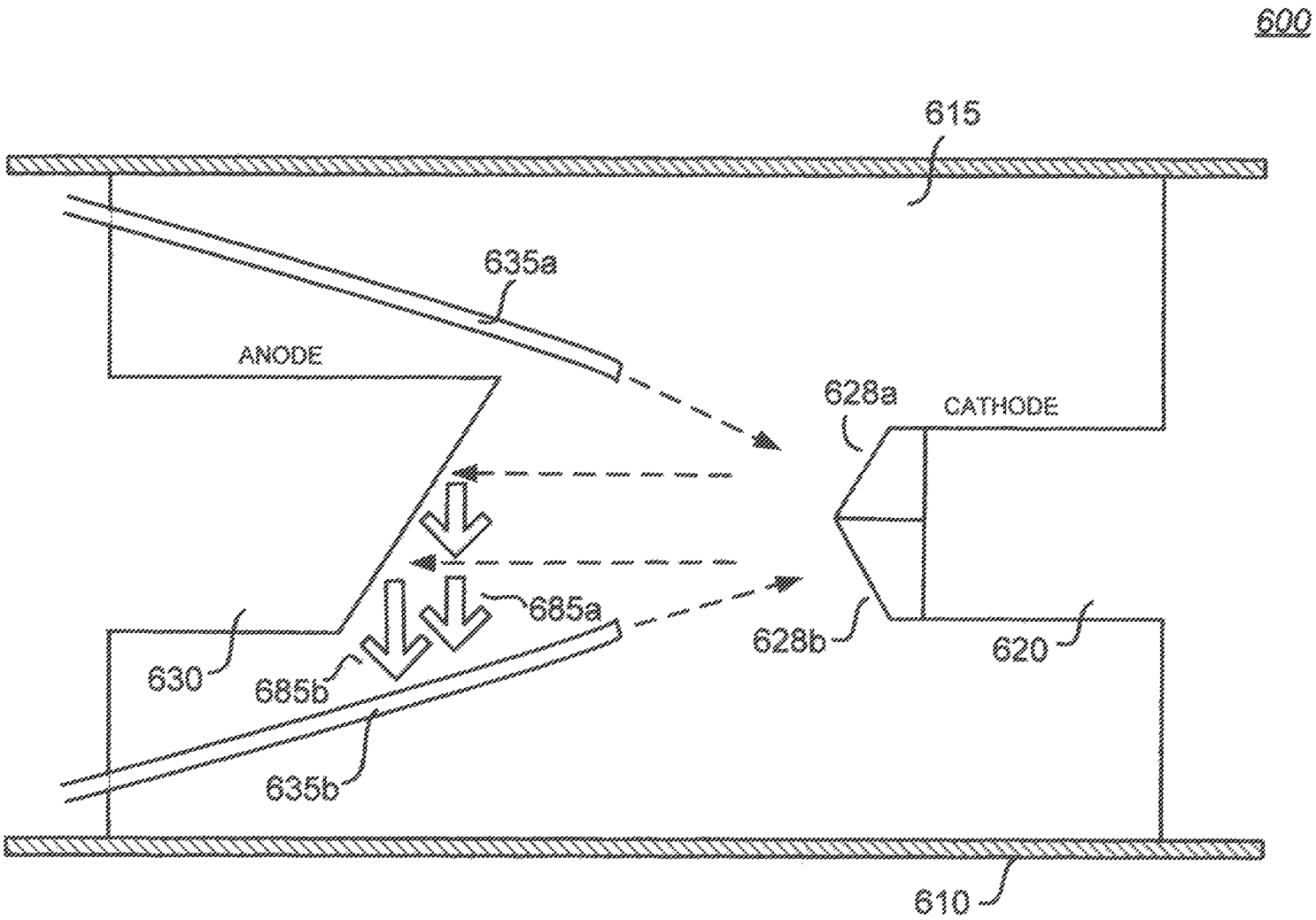
FIG. 6 is a cross-sectional illustration of another exemplary photocathode embodiment using a multi-fibered and multi-shaped/materialed photocathode.

FIG. 6 is a cross-sectional illustration of an exemplary beam forming x-ray generating device 600, with an envelope 610 and chamber 615 containing a cathode 620 with a shaped surface having two different photocathodic materials 628*a*, 628*b*, anode 630, and directing fiber optic lines 635*a*, 635*b*. In this embodiment, beam forming can be naturally facilitated by the shaped surfaces on cathode 620 and the respective target areas on anode 630, resulting in x-rays 685*a*, 685*b*.

Also, photocathodic materials 628*a*, 628*b* can be of a particular surface contour or shape that is complementary to the incoming light from the fiber optic lines 635*a*, 635*b*, respectively. At first impression, the complementary factor can be simply be described as configuring the surfaces of photocathodic materials 628*a*, 628*b* to be perpendicular to the incident light, to maximize the amount of exposure of the photocathodic materials 628*a*, 628*b* to the incident light. However, it is contemplated that other factors may be considered when designing the angle of the photocathodic materials 628*a*, 628*b* with respect to the incident light.

For example, it is known that light emanating from most commercial fiber optic lines will be more concentrated at its center than at its periphery (e.g., intensity gradient, dispersal, etc.). Therefore, in view of the characteristics of the incident light, some degree of "matching" of the photocathodic materials can be devised to increase efficiency. The complementary factor may be evident in the pattern of released electrons as they are directed to the anode 630, or how efficient the light is in releasing electrons based on an angle of incidence on the photocathodic materials, or any other factor that may arise.

X-rays 685*a* are illustrated as being generated from electrons arising from photocathodic material 628*a*, excited by light from fiber optic line 635*a*. Similarly, X-rays 685*b* are shown as being generated from electrons arising from photocathodic material 628*b*, excited by light from fiber optic line 635*b*. This embodiment demonstrates a design where it may be desirable to have multiple types of photocathodic materials on cathode 620, these multiple types having different shapes which provide some degree of control over the mechanisms for x-ray generation.

Accordingly, a "single" composite x-ray beam may be generated utilizing electrons simultaneously released from photocathodic materials 628*a* and 628*b*. Also, an alternating x-ray beam may be formed by a pulsing arrangement where in one instance x-rays from photocathodic material 628*a* is generated and in another instance x-rays from photocathodic material 628*b* is generated.

It is understood that depending on how "tight" the electron beam is from the cathode 620 to the anode 630, some (or even a lot of) electrons from the respective cathode surfaces may not travel in a straight line towards the anode 630, and electrons from photocathodic material 628*a* may strike the "lower" portion of anode 630 and conversely electrons from photocathodic material 628*b* may strike the "upper" portion of anode 630.

As discussed in FIG. 4, a broader x-ray beam can be formed, based on the separation distance between the cathode-side and anode-side. For example, in FIG. 6, it is anticipated that the x-ray beam 685*b* will be broader in width than the x-ray beam 685*a*, due to its respective anode section being "farther" from the cathode 620. This "dispersal" of electrons can be exploited (recognizing the beam dispersal rate by selectively illuminating cathode portions that are "farther/closer" to the anode, for example) to cause the resulting x-ray beam to be broad or narrow. Of course, this phenomenon is also controllable to a given extent by the amount of potential impressed between the cathode 620 and anode 630, as well as shaping of the photocathodic materials. In some embodiments, electron beam control aside from the mechanisms utilized herein may be implemented, depending upon design objectives.

Figure 7A:
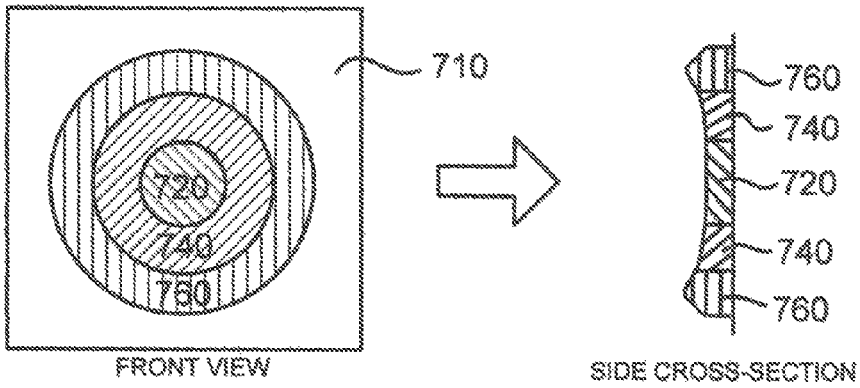
FIGS. 7A-C are illustrations of various exemplary photocathodic surfaces and an exemplary system for electron guidance/amplification.
Figure 7B:
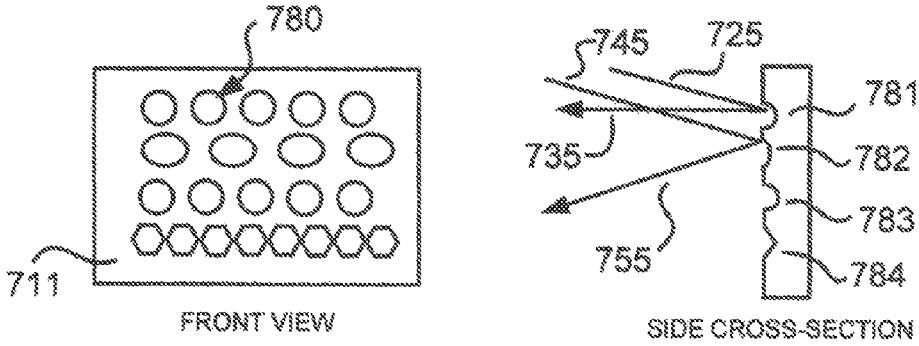
Figure 7C:
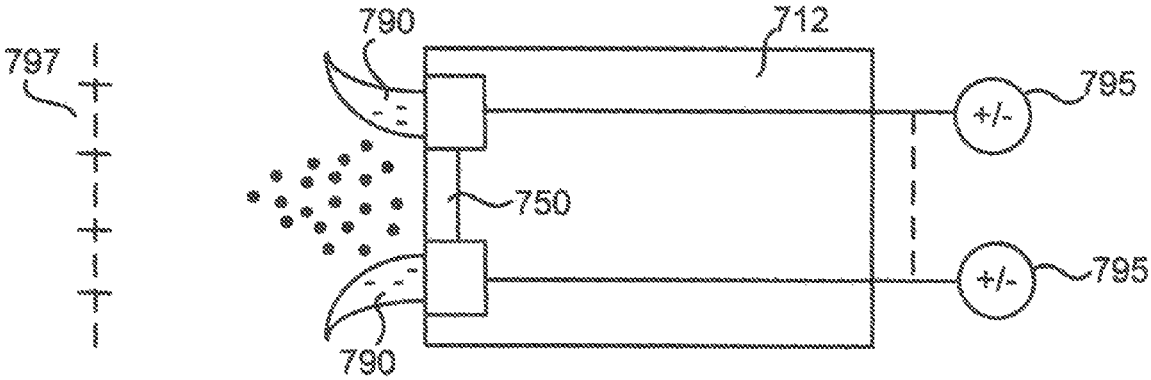

FIGS. 7A-B are illustrations of exemplary photocathodic contours and FIG. 7C is an illustration of an exemplary beam control/amplification approach. FIG. 7A shows a front view and side cross-sectional view of an exemplary photocathode 710 with different photocathodic materials 720, 740, 760 positioned in different annular regions. The "distribution" of photocathodic materials 720, 740, 760 can be configured to compensate for radial dispersion from an impinging light, or other factors that are evident. This embodiment also shows a symmetric curved face which provides a "focusing" feature whose contour or shape may be changed, according to design preference.

FIG. 7B shows a front view and side cross-sectional view of an exemplary photocathode 711 with individual photocathodic lenses 780 distributed across the face of photocathode 711. Each of the lenses 780 may have a different contour or even a different photocathodic material and may be individually positioned so as to correspond to individual optical beams (not shown). The side cross-sectional view illustrates a scenario where contours of the lenses 780 are significantly different (781 versus 782) causing the respective "focusing" to be directed to different directions. For example, light beam 725 upon lens 781 results in electron beam 735, and light beam 745 upon lens 782 results in electron beam 755. For illustrative purposes, lens 783 is shown to be similar to lens 781, while lens 784 is different from all the other lenses. The ability to provide microfocusing with different materials and/or different directions provides significant additional degrees of freedom.

The example shown in FIG. 7B demonstrates a non-symmetrical photocathode 711. Accordingly, it is noted that if the photocathode 711 is mechanically rotated, then it is possible to generate x-ray scanning. Or, in the event that one of the photocathodic lenses 780 is inoperative, another photocathodic lenses 783 may be "moved" into place. While on this subject of rotation/movement, it is expressly understood that in some embodiments, it may be possible to move the photocathode 711 rotationally or axially or in any direction, depending on design implementation. By reason of analogy, the same can be said for the anode (not shown).

FIG. 7C is a cross-sectional illustration of an exemplary beam control/amplification system using a shaped photocathode 712 with fielding arms 790 that are electrically charged to repel/attract electrons that are produced from photocathodic section 750. Fielding arms 790 can operate as focusing grids, analogous in many ways to beam focusing plates in a cathode ray television tube, confining or expanding the electrons (e.g., density) emitted from photocathodic section 750. Fielding arms 790 may be "separate" from photocathode 712 (being electrically insulated and having a variable power source 795—each fielding arms 790 either being separately controlled or controlled in unison), or may be integral to the photocathode 712, having its polarity proportional thereto. It is understood that the illustrated fielding arms 790 may not actually be "arm-shaped" or extend outwardly, possibly being any shape or configuration.

As a modification, optional amplifier grid 797 that generates a secondary source of electrons can be placed in the path of electrons emitted from photocathodic section 750, wherein electrons from the amplifier grid 797 can be combined to provide an "amplifying" capability.

Figure 8:
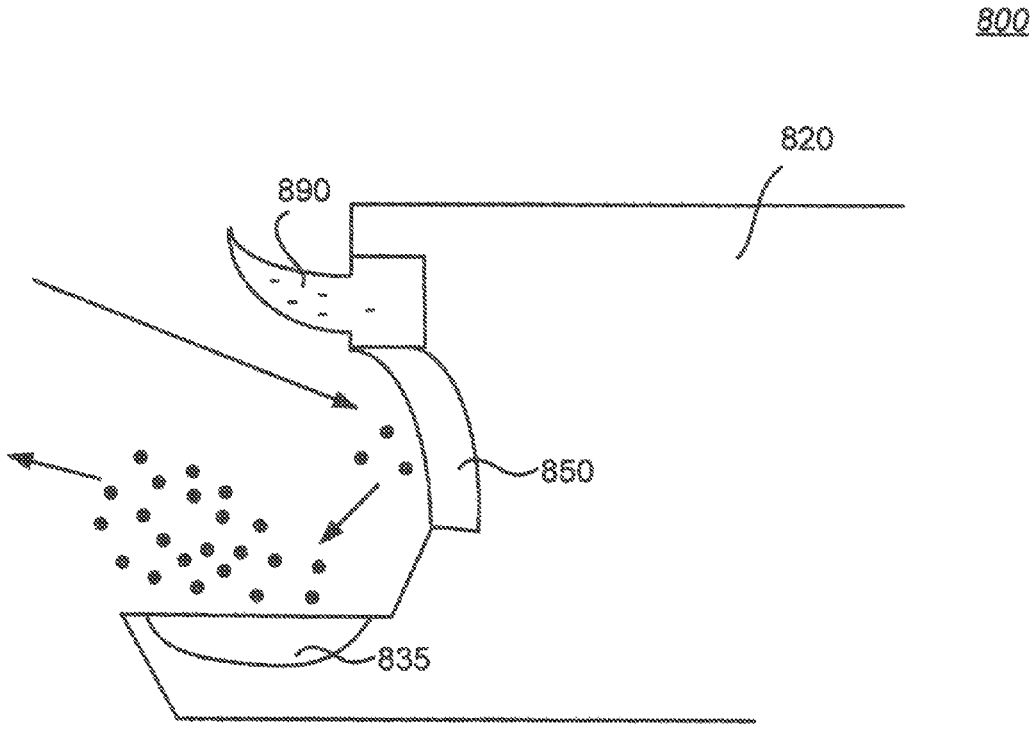
FIG. 8 is a cross-sectional illustration of an exemplary electron control/multiplier system.

FIG. 8 is an illustration of an exemplary electron control/multiplier photocathode system 800. In this example, fielding arm 890 operates to direct electrons emitted from photocathodic section 850 towards a material/device 835 that produces electrons as a function of electrons directed to it. In essence, material/device 835 is an electron amplifier that can be triggered/controlled by the amount of electrons generated from photocathodic section 850. In principle, material/device 835 can be a composition of materials or can be a form of the amplifier grid 797 described in FIG. 7C. Avalanche methods and other possible methods, and materials that exhibit a "multiplying" effect may be used, as according to design preference. FIG. 8 is demonstrative of one possible approach of using electrons from photocathodic section 850 as an indirect method for generating electrons.

This exemplary system 800 enables the use of photocathodic material(s) in photocathodic section 850 that may not be highly productive with respect to electron generation (which may arise from limitations in the light source or the photocathodic material) or may not be "finely" controllable in quantity of electrons or energy, but with the amplification/multiplier features of material/device 835, these deficiencies compensated for.

Accordingly, from the above FIGS, it is apparent that based on the disclosure provided herein, several modifications to shape, position, orientation, materials, etc. can be made to the photocathode and surrounding elements to allow for precise electron generation and trajectory. Therefore, while these FIGS. show certain configurations, other configurations, combinations, changes, etc., may be made without departing from the spirit and scope of this disclosure.

For example, the described fielding arms may be used to "attract" electrons, if so desired. Further, it is known that x-rays can theoretically be generated from a gas-based anode. Therefore, while the exemplary anodes shown herein are presumed to solid, it may be possible to configure a system that utilizes a gas or plasma-based anode that is triggered by the photocathodic approaches shown herein.

Figure 9A:
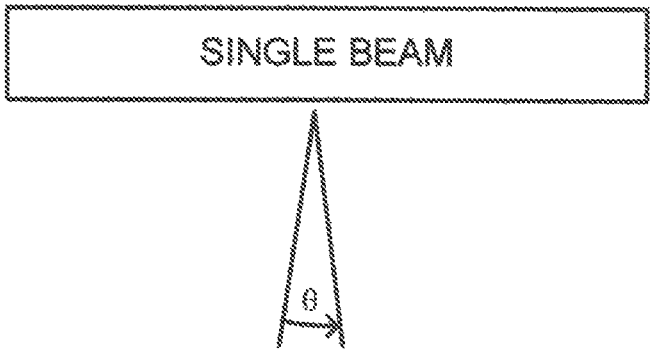
FIGS. 9A-C are illustrations of various exemplary scanning modes.
Figure 9B:
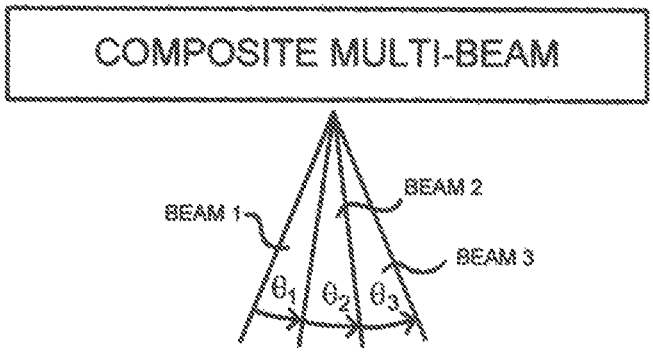
Figure 9C:
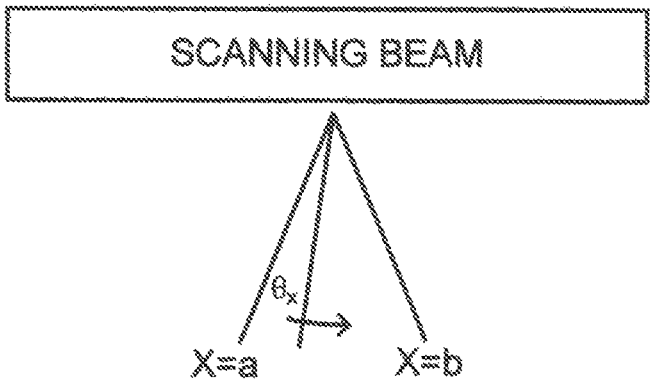

FIGS. 9A-C are illustrations showing some possible "scanning" modes of operation for some of the exemplary x-ray systems described herein. FIG. 9A illustrates a single beam mode of operation having a single fixed beam having a given θ angle. FIG. 9B illustrates a composite multi-beam mode of operation where a composite beam is composed of individual beams: beam 1, beam 2, and beam 3, corresponding to beam width angles $\theta_1$, $\theta_2$, and $\theta_3$, respectively. It is noted that more or less beams may be used and the beam width angles may be similar to each other or different, as well as displaced non-contiguously, or staggered in different orientations (e.g., checker board). FIG. 9C is an illustration of a "single" beam scanning mode of operation where a given θ angled beam is moved from a position x=a to a position x=b. Of course, it is understood that the beam may move along a non-"x" orientation, if so desired.

In view of the exemplary embodiments described herein, a new enabling technology is presented that possesses various novel and enabling characteristics not achievable by conventional x-ray tubes. It is understood that while what has been described above includes examples of one or more embodiments, it is, of course, not possible to describe every conceivable combination of components or methodologies for purposes of describing the aforementioned embodiments. However, one of ordinary skill in the art may recognize that many further combinations and permutations of various embodiments are possible. Accordingly, the described embodiments are intended to embrace all such alterations, modifications and variations that fall within the spirit and scope of the appended claims.

What is claimed is:

1. An x-ray generating device, comprising:

a substantially sealed envelope having a portion that allows x-rays to pass;

a fixed anode having a portion interior to the envelope, the anode having a first shaped face capable of generating x-rays in a predetermined direction when interacted upon by electrons;

a fixed cathode having a portion interior to the envelope and having a second shaped face containing a photocathodic material substantially opposite the anode;

a voltage differential between the cathode and the anode; and a fixed plurality of fiber optic lines directing light to the second shaped face of the cathode, a light emitting end of the fiber optic lines being interior to the sealed envelope and arranged with respect to the shaped faces to provide at least one of a scanning and beam shaping pattern when the light in the fiber optic lines is appropriately sequenced;

wherein the sequenced light impinging on the photocathodic material generates electrons which are directed to the anode by the voltage differential, resulting in at least one of scanning and beam shaped x-rays being generated by the anode and radiated out of the envelope.

2. The x-ray generating device of claim 1, wherein the fiber optic lines are capable of transmitting non-visible light.

3. The x-ray generating device of claim 1, further comprising a laser feeding light into the fiber optic lines, the laser having at least one of a continuous mode of operation and a pulsable mode of operation.

4. The x-ray generating device of claim 1, wherein the sealed envelope is either vacuumed or contains a gas.

5. The x-ray generating device of claim 1, wherein the cathode is entirely formed of the photocathodic material.

6. The x-ray generating device of claim 1, wherein the photocathodic material is at least one of, multi-materialed, and multi-layered.

7. The x-ray generating device of claim 1, wherein the photocathodic material is comprised of at least one of ytterbium (Yb), gallane-arsine (Ga—As), and cesium-antimony (Cs—Sb).

8. The x-ray generating device of claim 1, wherein the anode is comprised of a material that provides a specific x-ray characteristic.

9. The x-ray generating device of claim 8, wherein the material is tungsten.

10. The x-ray generating device of claim 1, wherein the anode contains a surface with a plurality of faces, wherein a first face is pointed in a first direction and a second face is pointed in a second direction, and the first direction is different from the second direction.

11. The x-ray generating device of claim 10, wherein the plurality of faces of the anode is comprised of a plurality of different materials that provide different x-ray characteristics.

12. The x-ray generating device of claim 1, wherein the portion of the sealed envelope is comprised of a material that is at least one of substantially transparent to x-rays and possesses an x-ray altering attribute.

13. The x-ray generating device of claim 1, wherein the anode is comprised of a plurality of anodes and the cathode is comprised of a plurality of cathodes.

14. The x-ray generating device of claim 1, further comprising at least one of a charged fielding arm, affecting a position of electrons generated from the photocathodic material, on the face of the cathode and an electron amplification grid positioned between the cathode and the anode.

15. The x-ray generating device of claim 14, further comprising an electron amplifier positioned on the face of the cathode, proximal to the photocathodic material.

16. A method for assembling a light-activated photocathodic/anode x-ray device, comprising:

forming a cathode with a photocathodic face by disposing a photocathodic material on a face of the cathode;

positioning a face of an anode displaced from and substantially opposite from the photocathodic face, the anode capable of generating x-rays in a predetermined direction when interacted upon by electrons;

enclosing the photocathodic face and the face of the anode in a sealable envelope; the envelope having a portion that allows x-rays to pass, wherein the cathode and anode are fixed and not movable;

directing a light emitting end of a plurality of fiber optic lines towards the photocathodic face in the envelope, the light emitting end being interior to the envelope and arranged with respect to the photocathodic face and face of the anode to provide at least one of a scanning and beam shaping pattern when the light in the fiber optic lines is appropriately sequenced;

sealing the envelope to provide an environment between the photocathodic face and the face of the anode that allows substantially unrestricted travel of electrons;

attaching a voltage or current carrying line to at least one of the cathode and anode; and sequencing light into the fiber optic lines to impinge on the photocathodic face to generates electrons which are directed to the anode by an impressed voltage differential, resulting in at least one of a scanning and beam shaping pattern of x-rays being generated by the anode and radiated out of the envelope.

17. The method of claim 16, further comprising attaching a light-generating source to a light entering end of the fiber optic lines.

18. The method of claim 16, wherein the cathode is formed entirely of the photocathodic material.

19. The method of claim 16, wherein the plurality of fiber optic lines are arranged to form a geometric array, directing light in a geometric pattern upon the photocathodic face.

20. The method of claim 16, wherein the photocathodic face is formed to be at least one of shaped, multi-materialed, and multi-layered.

21. The method of claim 16, further comprising forming the face of the anode to be multi-faced, wherein at least one of the anode's multi-face is pointed in a different direction than an other one of the anode's multi-face.

22. The method of claim 16, further comprising forming a plurality of different materials on the face of the anode, the different materials providing different x-ray characteristics.

23. The method of claim 16, further comprising forming at least one of a charged fielding arm on the face of the cathode, capable of affecting a position of electrons generated from the photocathodic material, and positioning an electron amplification grid between the cathode and the anode.

24. The method of claim 16, further comprising positioning an electron amplifier on the face of the cathode, proximal to the photocathodic material.

25. The method of claim 16, wherein the beam forming is two-dimensional.

* * * * *